US005510761A

United States Patent [19]

Böder et al.

[11] Patent Number: 5,510,761

[45] Date of Patent: Apr. 23, 1996

[54] CONTACT SYSTEM FOR A CURRENT LIMITING UNIT

[75] Inventors: Franz Böder, Ahrbrück; Bernd Howald, Bonn, both of Germany

[73] Assignee: Klöckner Moeller GmbH, Bonn, Germany

[21] Appl. No.: 322,018

[22] Filed: Oct. 11, 1994

[30] Foreign Application Priority Data

Oct. 11, 1993 [DE] Germany ..... 43 34 577.8

[51] Int. Cl.[6] ..... H01H 9/00

[52] U.S. Cl. ..... 335/172; 335/132; 335/202

[58] Field of Search ..... 335/35, 23–25, 335/167–176, 132, 202, 16, 147, 195

[56] References Cited

U.S. PATENT DOCUMENTS

| | | | |
|---|---|---|---|
| 5,027,096 | 6/1991 | White et al. . | |
| 5,073,764 | 12/1991 | Takahashi et al. | 335/195 |
| 5,146,194 | 9/1992 | Altenhof, Jr. et al. | 335/147 |
| 5,159,304 | 10/1992 | Yamagata et al. | 335/16 |

FOREIGN PATENT DOCUMENTS

| | | |
|---|---|---|
| 041875 | 3/1991 | European Pat. Off. . |
| 1141012 | 12/1962 | Germany . |
| 3411276 | 10/1984 | Germany . |
| 91072189 | 4/1991 | U.S.S.R. . |
| 2033158 | 5/1980 | United Kingdom . |

*Primary Examiner*—Lincoln Donovan
*Attorney, Agent, or Firm*—Nils H. Ljungman & Associates

[57] ABSTRACT

A contact system for current limiting units which are combined with power circuit breakers or motor circuit breakers. The object of the invention is to improve the reliability of the current limiting unit equipped with such a contact system, while reducing the time and effort required to assemble and install such a contact system. The invention teaches that the contact systems can be assembled from a contact carrier with a stationary contact tip and a subsystem preassembled with little force, which can be installed in the arcing chambers in a stable condition and under the force of contact compression springs. The subsystem contains the wiper provided with the moving contact tip, which wiper is mounted with a direct electrical connection to a supply lead. Supports in the subsystem limit the movement of the wiper in both directions. A support block provided with a holding groove and auxiliary groove for the non-positive assembly of the parts connected to the contact compression springs makes it possible to preassemble the subsystem by means of an intermediate state which is also stable.

20 Claims, 5 Drawing Sheets

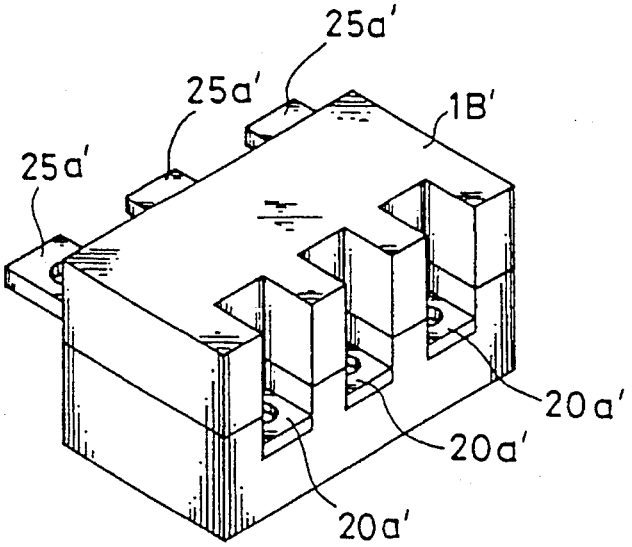
FIG. 6
FIG.7
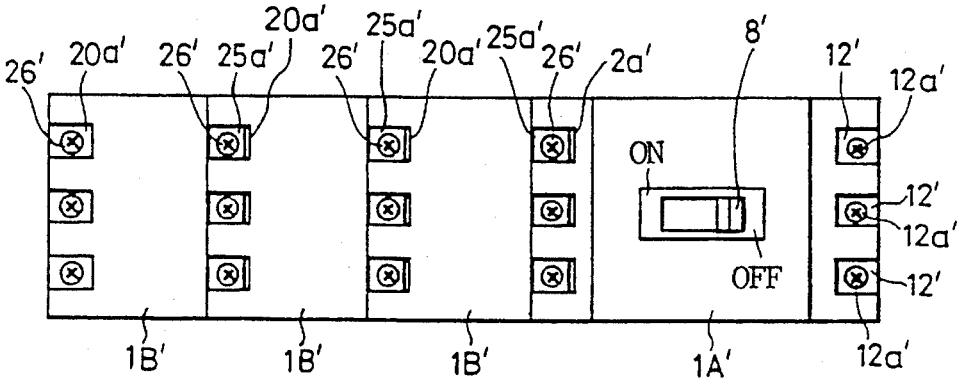
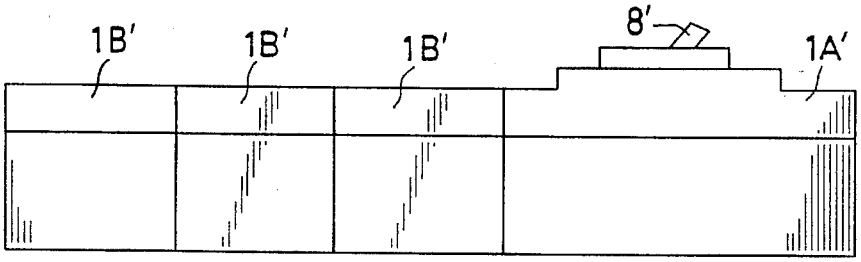
FIG. 8

CONTACT SYSTEM FOR A CURRENT LIMITING UNIT

BACKGROUND OF THE INVENTION

1. Field of the Invention

The present invention generally relates to a contact system for a current limiting unit, such a current limiting unit having a molded housing and further including: a movable wiper with a moving contact tip on one end and an axis of rotation on the other end; a supply lead to be connected to the wiper, and which supply lead makes a transition into a first current lead; a stationary contact carrier with a stationary contact tip on one end and a second current lead on the other end, preferably with a partial segment with a current direction opposite to that in the wiper; and contact compression springs mounted on one end of the wiper.

The present invention can also particularly relate to a contact system for current limiting units which are combined with power circuit breakers or motor circuit breakers.

2. Background Information

European Patent Application No. 418 755 A2 discloses a three-phase current limiting unit with such a contact system, as shown in FIG. 2 of that application. Three current-limiting contact systems are next to one another in a molded housing. Each contact system essentially consists of a stationary contact carrier with a stationary contact tip and a movable wiper with a movable contact tip. The contact carrier and wiper run parallel to one another over a significant portion of their length. Each contact carrier makes a transition into a load-side connection terminal lug. Each wiper is mounted on an axis of rotation and is connected by means of a flexible connecting conductor (flexible lead) to a supply lead which is to be connected to the corresponding output terminal of a power circuit breaker. Each wiper is acted on by a helical rotation spring, or compression spring, attached to the axis of rotation, so that the moving contact tip is connected under a corresponding contact pressure to the stationary contact tip. In the event of a short circuit, the electrodynamic repulsive forces which are generated by the short circuit current running in opposite directions in the contact carrier, and in the wiper, exceed the contact pressure force, which leads to the spinning off of the wiper and thus to the opening of the contact system. The arc formed between the separated contact tips is deionized in an arc extinction chamber.

European Patent Application No. 418 755 A2 also discloses an additional current-limiting contact system, as shown in FIG. 24 of that application. In this contact system, the wiper is mounted on a bearing block connected to the base of the molded housing by means of its axis of rotation. Between the wiper and the bearing block, helical tension springs are engaged on both sides by means of interlocking dowels, to generate the necessary contact pressure.

The disadvantages of these contact systems are that the contact systems, as a result of the necessary high prestress of the contact compression springs, can only generally be mounted by means of a complex and time-consuming process, and a great deal of force is usually required to install them in the molded housing. Furthermore, the opening angle during the spinning-off of the wiper is essentially not defined, and the current transmission essentially does not take place directly between the wiper and the supply lead. The spinning-off tends to be limited either by the counter forces of the contact compression springs or by stops on the molded housing. In the former case, the contact compression springs could be damaged by excessive stretching, and in the latter case parts of the molded housing could be damaged by impacts or melting. As a result of the force of the interposed flexible connecting conductor, the electrodynamic behavior and thus the lower limit for the opening short circuit current cannot typically be reproduced with sufficient accuracy.

German Patent Application No. 34 11 276 C2 discloses a power circuit breaker with a contact system whose wiper can pivot, and is connected in an electrically conductive manner to a bearing, or journal, on which journal the axis, axle or shaft of rotation for the fork-shaped end of the wiper is mounted. Prestressing means essentially guarantee a sufficiently conductive connection between the wiper and the bearing, which bearing makes a transition within a single piece into a terminal bracket. For its part, the terminal bracket is connected to a current connection with the interposition of a bimetallic heating element.

The solution disclosed in the above-cited German Patent Application does not appear to represent a pure current limiter, and is apparently designed to reverse the electrodynamically opened wiper on next breaker mechanism to be tripped. The motion of the spun-off wiper is disadvantageously limited by the moving parts connected to the actuating shaft. This known contact system is also rather difficult to assemble and install, since on one hand a very considerable number of individual parts, some of which are very complex, must apparently be assembled, and on the other hand, during the assembly process, it appears to be necessary to overcome the strong spring forces of the contact compression springs engaged between the wiper and the axis of rotation.

OBJECT OF THE INVENTION

The object of the present invention is therefore to reduce the time and effort required for the assembly of a contact system of the type described further above, while improving the reliability of the current limiting unit of which the contact system is a part.

SUMMARY OF THE INVENTION

Starting with a contact system of the type described further above, the present invention teaches that the above object can be accomplished, in accordance with at least one embodiment of the present invention, by the following features: the supply lead is preferably a one-piece component which makes a transition into a bearing, at which bearing the axis, axle or shaft of rotation is preferably mounted and, as a result of application forces, there is preferably a conductive connection to the wiper; the contact compression springs are preferably held with their other end on the supply lead; the wiper is preferably supported in the direction of the force of the contact compression springs by covering the travel by means of a first support point on the supply lead; the wiper is preferably supported opposite to the direction of the force exerted by the contact compression springs when it reaches the maximum opening angle by means of a second support point on the supply lead; the contact compression springs can preferably be mounted with their other end on the supply lead so that, during assembly, a lower force is exerted than in the final installed position.

As a result of the configuration of the supply lead with the bearing, the first and second support points for the wiper can advantageously perform several functions. The simultaneous mounting and direct current connection, as well as the limitation of motion for the wiper, can create defined and reproducible conditions for the current limiting action of the contact system. The first support point can essentially limit the wiper making contact until maximum travel. Within the maximum travel, which can essentially play a role in the erosion of the contact tips to the allowable extent, a sufficient residual contact pressure force is essentially exerted on the contact tips. The second support point can preferably limit the motion, and thus the opening angle, of the electrodynamically opening wiper by means of the contact system itself. The easily installed mounting of the wiper at the bearing and the friction-locked end mounting of the contact compression springs make possible the uncomplicated assembly of the subsystem connected to the wiper in the tensioned, stable state in the contact space. As a result of the intermediate mounting taught by the invention, these parts can be pre-assembled in advance, which can essentially require only a low level of force. Then, the contact compression springs can preferably be moved, which movement can also require essentially only a low level of force, into the end mounting, at which point the subsystem is in a tensioned state, ready to be installed. Of course, a single, suitably-configured and oriented contact compression spring can also be used.

Additional advantageous configurations of the invention are also disclosed herebelow. The mounting of the contact compression springs by means of dowels and mounting blocks can represent particularly suitable means for achieving the effects contemplated by the present invention. The sloping, bevelled or diagonal transition from the auxiliary groove into the holding groove can essentially facilitate the transition from the intermediate mounting into the final mounting of the contact compression springs. The configuration of the wiper by two wiper strips can be particularly advantageous for the bearing and the conducting connection to the supply lead. This electrical connection can essentially be promoted by the application spring. The prismatic seating of the mounting block on the holding web can essentially facilitate assembly and increase the mechanical stability of the subsystem. The above-mentioned configurations of the supports can be particularly appropriate with regard to the ease of manufacture and reliable operation of the contact system. The symmetrical configuration of the holding block can essentially make it possible to install the holding block in two positions rotated by 180 degrees from one another, which leads to a reduction of assembly defects. In other words, in accordance with at least one preferred embodiment of the present invention, it is conceivable that the holding block, by virtue of its symmetry, can be selectively installed in either of two different positions, both of which positions are essentially rotated by about 180 degrees with respect to one another, both of which positions can preferably provide essentially the same results. Accordingly, at least partly owing to this flexibility in installation of the holding block, it is conceivable that assembly defects can be reduced.

When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

In summary, one aspect of the invention resides broadly in a current limiting unit comprising: housing means; a contact system disposed at least partly within the housing means; the contact system comprising: first lead means and second lead means; the first lead means having means for connecting to first means for conveying electrical current; the second lead means having means for connecting to second means for conveying electrical current; means for providing electrical communication between the first lead means and the second lead means; the means for providing electrical communication comprising: wiper means, the wiper means having means for conveying electrical current; first connecting means for electrically connecting the first lead means with the wiper means; second connecting means for electrically connecting the wiper means with the second lead means; means for displaceably mounting the wiper means to permit displacement of the wiper means relative to the second lead means; the second connecting means comprising: a first contact portion disposed on the wiper means; and a second contact portion disposed on the second lead means; the first contact portion and the second contact portion being engageable with one another to electrically connect the wiper means with the second lead means; means for biasing the wiper means towards the second lead means, to maintain the first contact portion and the second contact portion in engagement with one another, to maintain the electrical connection between the wiper means and the second lead means; means for displacing the wiper means away from the second lead means, to disengage the first contact portion from the second contact portion, to disrupt the electrical connection between the wiper means and the second lead means; and the wiper means, the first lead means, the biasing means, the first connecting means and the first contact portion forming a single, integral, pre-assembled unit.

Another aspect of the invention resides broadly in a method of assembling a current limiting unit, the method comprising the steps of: providing housing means; providing a contact system for being disposed at least partly within the housing means; the step of providing a contact system comprising the steps of: providing first lead means and second lead means; the step of providing first lead means comprising the step of providing means for connecting to first means for conveying electrical current; the step of providing second lead means comprising the step of providing means for connecting to second means for conveying electrical current; providing means for providing electrical communication between the first lead means and the second lead means; the step of providing means for providing electrical communication comprising the steps of: providing wiper means, the wiper means having means for conveying electrical current; providing first connecting means for electrically connecting the first lead means with the wiper means; providing second connecting means for electrically connecting the wiper means with the second lead means; providing means for displaceably mounting the wiper means to permit displacement of the wiper means relative to the second lead means; the step of providing second connecting means comprising the steps of: providing a first contact portion and disposing the same on the wiper means; and providing a second contact portion disposing the same on the second lead means; configuring the first contact portion and the second contact portion to be engageable with one another to electrically connect the wiper means with the second lead means; providing means for biasing the wiper means towards the second lead means, to maintain the first contact portion and the second contact portion in engagement with one another, to maintain the electrical connection between the wiper means and the second lead means;

providing means for displacing the wiper means away from the second lead means, to disengage the first contact portion from the second contact portion, to disrupt the electrical connection between the wiper means and the second lead means; and forming the wiper means, the first lead means, the biasing means, the first connecting means and the second connecting means as a single, integral, pre-assembled unit; the method further comprising the additional steps of: storing the single, integral pre-assembled unit constituted by the wiper means, the first lead means, the biasing means, the first connecting means and the first contact portion; and installing the single, integral pre-assembled unit at least partly within the housing means.

BRIEF DESCRIPTION OF THE DRAWINGS

Additional details and advantages of the present invention are explained in greater detail below, with reference to at least one embodiment which is illustrated in the accompanying drawings, wherein:

FIG. 6 is a perspective view showing the current limiting unit shown in FIG. 4;

FIG. 7 is a plan view showing a current limiting circuit breaker with three current limiting units; and FIG. 8 is a side view showing the current limiting circuit breaker of FIG. 7.

DESCRIPTION OF THE PREFERRED EMBODIMENT

Figure 1:
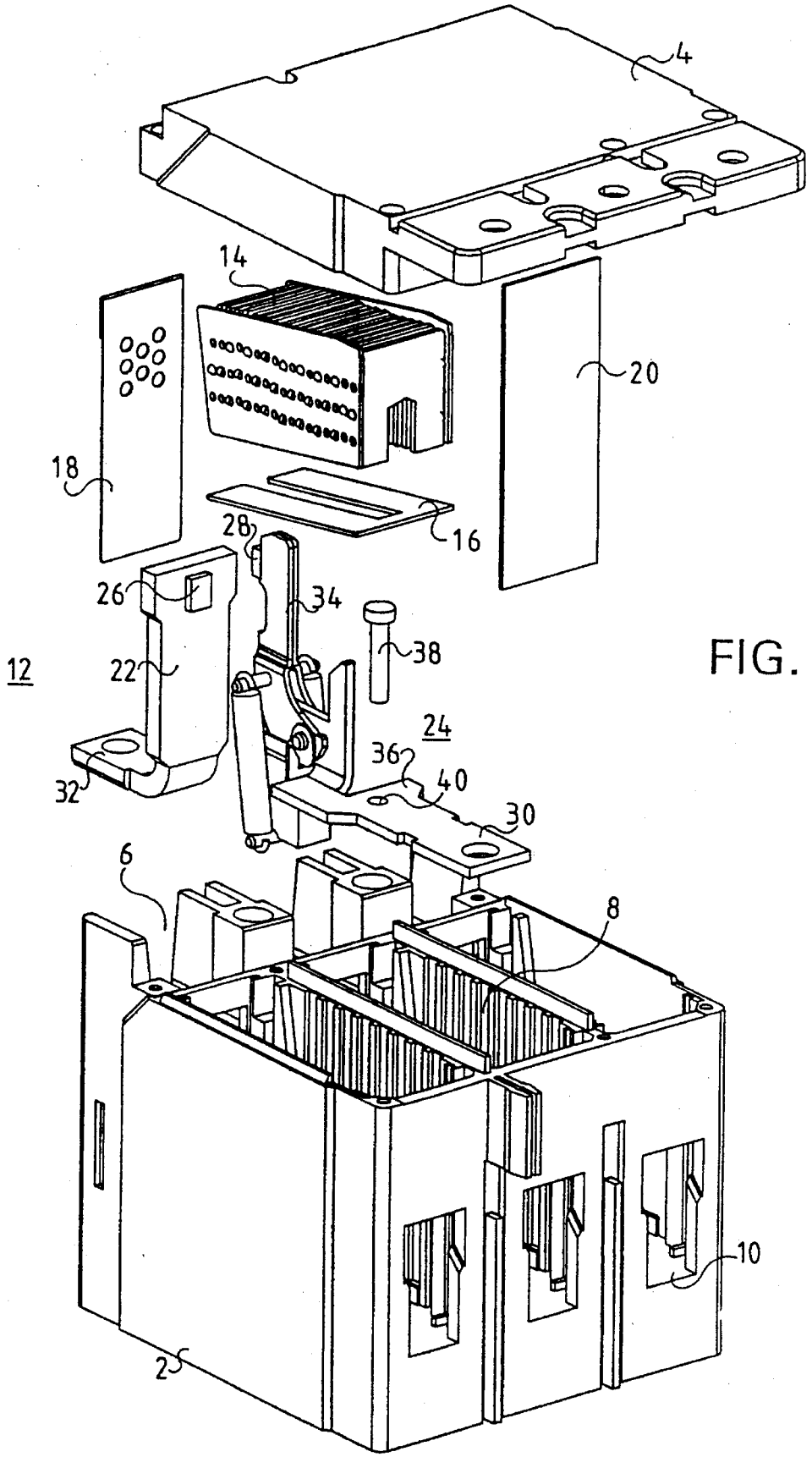
FIG. 1 shows a current limiting unit with a contact system as claimed by the invention, in an exploded view.

As shown in FIG. 1, a three-pole current limiting unit can preferably be enclosed by a molded housing. The molded housing can preferably include a bottom part 2 and a closing cover 4. In the bottom part 2, there can preferably be three load-side terminal housings 6, arcing chambers 8 and circuit-breaker-side terminal openings 10.

In each arcing chamber 8, there is preferably a contact system 12 and an arc splitter plate stack 14 with a corresponding separating plate 16, blow-out valve plate 18 and cover plate 20. The contact system 12 can preferably include a stationary contact carrier 22 and a pre-assembled subsystem 24. The contact carrier 22 is preferably inserted in an interlocked manner in the bottom part 2, and on one end can preferably have a stationary contact tip piece 26, and on the other end can preferably make an angled, possibly a right-angled, transition into a second current feed 32. Second current feed 32 preferably extends into the terminal housing 6.

The subsystem 24 preferably has a moving wiper 34 with a terminal movable contact tip 28 which, under normal conditions, is preferably in conducting contact with the stationary contact tip 26. The wiper 34 is preferably connected in a pivoting fashion with a supply lead 36. The supply lead 36 preferably makes a transition, on its end, into a first current lead 30, which first current lead 30 preferably extends through the terminal opening 10. By means of screws 38, the supply lead 36, and thus the preassembled subsystem 24, can preferably be fastened by means of holes 40 on the base of the arcing chamber 8.

The current flow preferably runs from the first current lead 30 via the supply lead 36, the wiper 34, the moving contact tip 28, the stationary contact tip 26 and the contact carrier 22 to the second current lead 32. The current preferably runs in opposite directions in the wiper 34 and in the contact carrier 22, and in the event of a short circuit, an electrodynamic force can essentially be generated which attempts to push the wiper 34 away from the contact carrier 22.

Thus, generally, in accordance with at least one preferred embodiment of the present invention, as should be generally well-known to those of ordinary skill in the art, current can preferably run in opposite directions in wiper 34 and contact carrier 22. Accordingly, it will be appreciated that a magnetic field will be created around each of wiper 34 and contact carrier 22. As will be apparent to those of ordinary skill in the art, these magnetic fields will tend to repel one another, but with the current at a sufficiently low level, the repulsion forces will essentially not be adequate for separating wiper 34 and contact 22 away from one another. Thus, when the current is sufficiently high, such as in the event of a short circuit, a sufficient magnetic repulsion can be created between wiper 34 and contact carrier 22 so as to displace wiper 34 away from contact carrier 22, towards the support 78.

Figure 2:
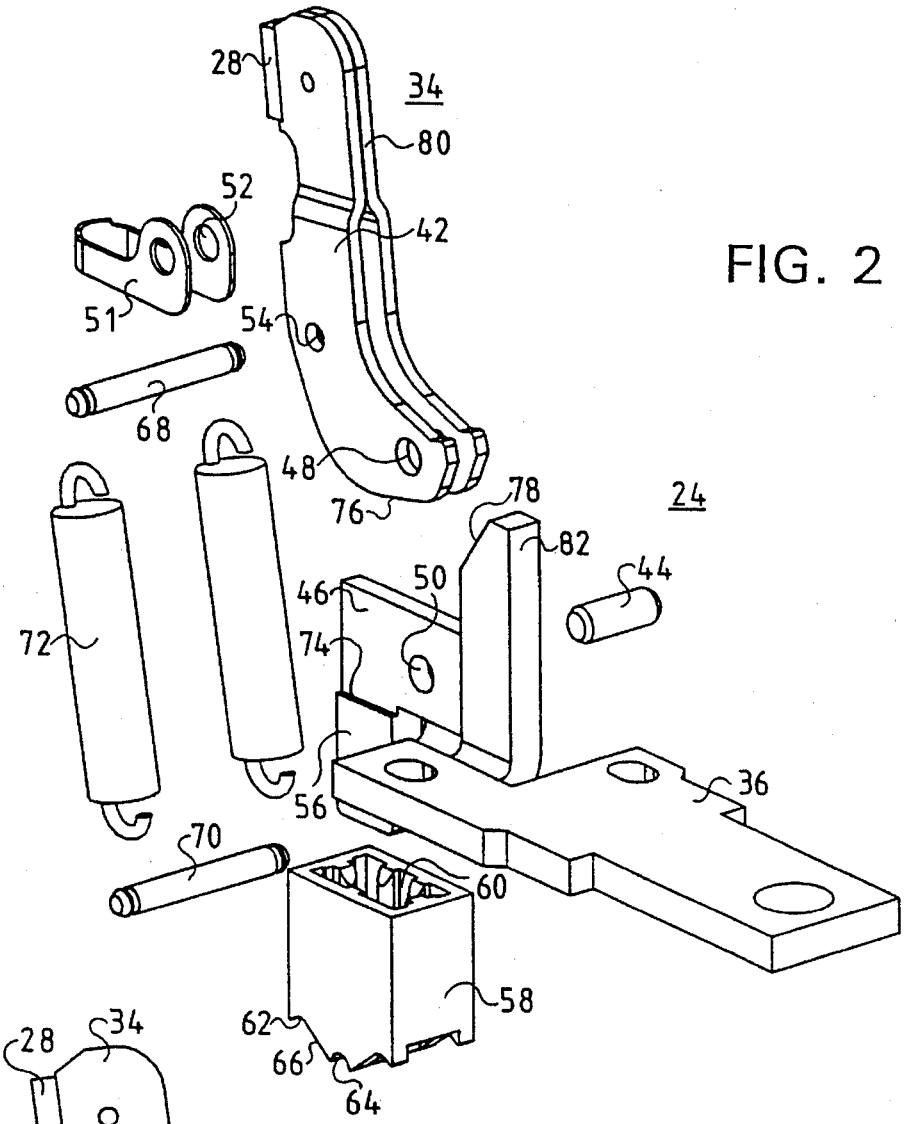
FIG. 2 shows a subsystem of the contact system in an exploded view.

FIG. 2 shows illustrations of the individual parts preassembled with the wiper 34 as a subsystem 24. The wiper 34 preferably includes two symmetrically parallel wiper strips 42. The wiper strips 42 are preferably connected to one another on the end toward the moving contact tip 28, and on the other end are preferably mounted at a distance from one another by means of an axis, axle or shaft of rotation 44 on a bearing 46 of the supply lead 36. The bearing 46 is preferably oriented at right angles to the supply lead 36. To mount the axis, axle, or shaft of rotation 44, there are preferably corresponding bearing holes 48 and 50 in the wiper strips 42 and the bearing 46 respectively. To create the necessary application force for a satisfactory electrical connection between the bearing 46 and the wiper strips 42, which wiper strips 42 surround the bearing 46 on both sides, on one hand the separated wiper strips 42 can preferably be prestressed inwardly, and on the other hand a U-shaped application spring 51 which surrounds the wiper strips 42 can preferably be mounted by means of corresponding mounting holes 52 on the axis of rotation 44.

The bearing 46 preferably extends in a web-like fashion away from the wiper 34 in a square-shaped support web 56. On the support web 56 preferably sits a support block 58 with a corresponding prismatic recess 60. The support block 58 is preferably made of insulation material, and is preferably symmetrical with respect to its center plane which runs with the support web 56, so that the support web 56 can also be attached in the position offset by 180 degrees from this center plane. On the side facing away from the wiper 34, the support block 58 can preferably have two auxiliary grooves 62 which are symmetrical to one another, and a support groove 64 located centrally between them. The grooves 62, 64 preferably run parallel to the axis of rotation 44. The auxiliary grooves 62 each preferably make a transition by means of a slope 66 into the support groove 64.

In the wiper strips 42, between the moving contact tip 28 and the bearing holes 48, there are preferably additional mounting holes 54 for a first dowel 68 which is held centrally in these holes 54. A second dowel 70 is preferably disposed in the support groove 64. A spiral-shaped contact compression spring 72, which exerts tension, is preferably suspended with its hook-shaped ends between the projecting ends of the dowels 68, 70, on both sides of the wiper 34. As a result of the force exerted by the contact compression springs 72, the second dowel 70 can preferably be held in the support groove 64 and with the latter, the support block 58 is held on the support web 56 in a friction-locked manner.

Thus, in accordance with at least one preferred embodiment of the present invention, support 58 may preferably be configured so as to be able to friction-lock or force lock with respect to support web 56. To this end, as illustrated in FIG. 2*a*, the recess 60 may preferably have disposed therein a series of ribs 61, which ribs 61 preferably run vertically and are preferably uniformly distributed about the periphery of recess 60.

Figure 2A:
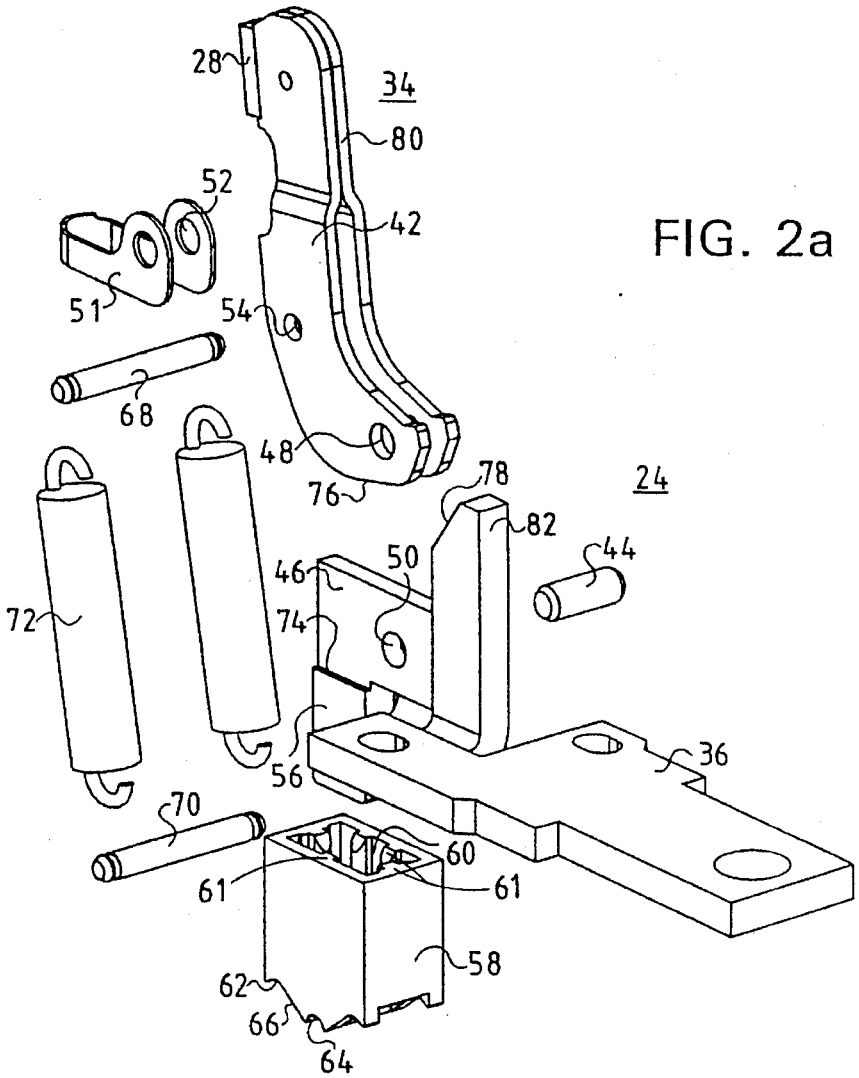
FIG. 2*a* is substantially the same view as FIG. 2, but more detailed.

FIG. 2*a* more clearly indicates the two auxiliary grooves 62 discussed above.

Figure 3:
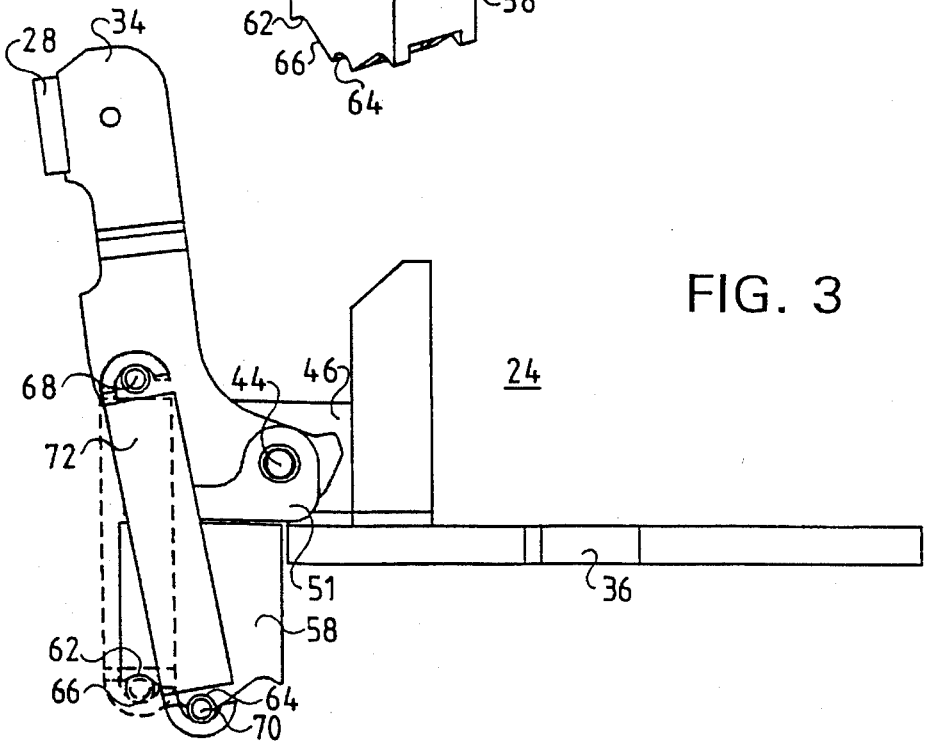
FIG. 3 shows the parts illustrated in FIG. 2 in the pre-assembled condition, in a side view.

As shown in FIGS. 2 and 3, the points of engagement of the contact compression springs 72 on the dowels 68, 70 preferably form a plane which is between the axis of rotation 44 and the contact carrier 22. As a result of this spatial orientation of the contact compression springs 72, pressure will essentially be exerted on the wiper 34 toward the stationary contact tip 26, i.e. such that the contact tips 26 and 28 are under contact pressure.

As a result of the transition of the bearing 46 into the somewhat thicker support web 56, shoulders 74 are preferably formed, against which the support surfaces 76 located on the corresponding end of the wiper strips 42 can be supported. By means of the shoulders 74 and the support surfaces 76, a first support point can preferably be formed, which first support point is preferably turned toward the contact carrier 22 in relation to the plane formed by the axis of rotation 44 and the second dowel 70. As a result of the first support point, the movement of the wiper 34 caused by the contact compression springs 72 will essentially be limited in the preassembled state of the subsystem 24. The subsystem 24 can thus be easily installed in the arcing chamber 8. The movement clearance of the moving contact tip 28 which results from the difference in position between the contact making of the unworn contact tips 26, 28 which produces the contact pressure and the support of the wiper 34 on the first support, can essentially be designated the maximum travel. Up to the allowable extent of the maximum travel, the contact tips 26, 28 can be worn away by arc erosion, whereby a sufficiently constant contact pressure force is exerted on the contact tips 26, 28 which come into contact with one another.

Thus, in accordance with at least one preferred embodiment of the present invention, the subsystem 24, when in a preassembled state, that is, prior to installation of the subsystem 24 in a current limiting unit, support surfaces 76 of wiper 34 will preferably be directly interfaced with shoulders 74 by way of the biasing provided by spring or springs 72. Upon installation of the subsystem 24 in a current limiting unit, in accordance with at least one preferred embodiment of the present invention, the contact tip 28 of wiper 34 can preferably interface with stationary contact tip 26 in such a manner that support surfaces 76 of wiper 34 may conceivably be moved away from shoulders 74. However, in such an arrangement, any wear on either or both of the contact tips 26, 28 would essentially not preclude the maintenance of an essentially constant contact pressure of tips 26, 28 with respect to each other, in the sense that the wiper 34 would continue to be biased by compression spring or springs 72 towards contact carrier 22 until support surfaces 76 would again become interfaced with shoulders 74 after sufficient wear on either or both of the contact tips 26, 28.

As a result of the electrodynamic effect of a strong current in the event of a short circuit, the wiper 34 is preferably spun out, i.e. displaced generally away from contact carrier 22, overcoming the contact pressure forces of the stationary contact tip 26. This current-limiting opening is preferably unaffected by the direct electrical connection of the supply lead 36 and wiper 34, and by undefined force effects of a flexible connecting conductor of known arrangements. The electrodynamic opening action of the contact system 12 can also be defined more precisely by the limitation of the opening angle. For this limiting, there is preferably a second support. This second support can preferably be embodied by a stop surface 78 inclined to correspond to a maximum opening angle of the wiper 34, and by portions 80 of the surface on the wiper 34 which can be supported thereagainst. The stop surface 78 can preferably be located on the end and facing the wiper 34 on a stop web 82, which stop web 82 can preferably extend at a right angle from the supply lead 36 together with the bearing 46. The parts 80 of the surface which interact with the stop surface 78 can preferably be embodied by the end surfaces of the wiper strips 42 facing away from the moving contact tip 42. When the maximum opening angle is reached, the first dowel 68 will preferably be facing the plane formed through the second dowel 70 and the axis of rotation 44, as well as the contact carrier 22, so that after the short circuit is turned off, the wiper 34 will once again preferably be connected to the stationary contact tip 26.

Thus, in accordance with at least one preferred embodiment of the present invention, wiper 34 will preferably displace away from contact carrier 22, such as in the presence of a short circuit, in a manner such as that described heretofore. Whereas, in known arrangements, a flexible connecting conductor may have been present, there will now essentially be no undefined force effects resulting therefrom. Further, stop surface 78 can preferably be provided to more precisely limit the opening angle of wiper 34. Preferably, stop surface 78 can be inclined in such a manner so as to essentially directly interface with corresponding surface portions 80 of wiper 34. Upon deactivation of a short circuit, wiper 34 can preferably once again displace towards contact carrier 22 to resume the conductive connection between contacts 26 and 28. In accordance with at least one preferred embodiment of the present invention, this could conceivably be accomplished by a reduction in the repulsive magnetic force between wiper 34 and contact carrier 22, in combination with the biasing provided by compression spring or springs 72.

FIG. 3 illustrates the preassembly of the subsystem 24. The wiper 34 is first preferably mounted with the axis of rotation 44 and the application spring 51 on the bearing 46. The contact compression springs 72 are preferably suspended on the first dowel 68 which is inserted in the wiper 34. The second dowel 70 is preferably inserted into the auxiliary groove 62 of the support block 58 placed on the supply lead 36, i.e. in the groove which is farthest away from the axis of rotation 44, and the contact compression springs 72 can be suspended on the ends of the dowel 70 applying very little force. The wiper 34 will thus essentially already be under a slight force exerted by the contact compression springs 72, and is essentially in a stable condition as a result of the movement limitation by the first support point. In this intermediate state, the contact compression springs 72 will essentially be in the position indicated by broken lines in FIG. 3. The subsystem 24 is preferably moved into the final, pre-assembled position by pushing the second dowel 70 plus the contact compression springs 72 with a slight application of force, and using the laws of the inclined plane, via the slope 66 into the holding groove 64.

FIGS. 4 through 8 show embodiments of a current limiting circuit breaker in which a current limiting unit according to the present invention may conceivably be employed. It is to be understood that, in accordance with at least one embodiment of the present invention, components discussed herebelow with relation to FIGS. 4 through 8 may be considered to be interchangeable, if appropriate with similar components discussed hereinabove with relation to FIGS. 1 through 3. For example, the current limiting unit 1B' discussed herebelow may be considered to be interchangeable with the current limiting unit described hereabove with relation to FIGS. 1 through 3.

Figure 4:
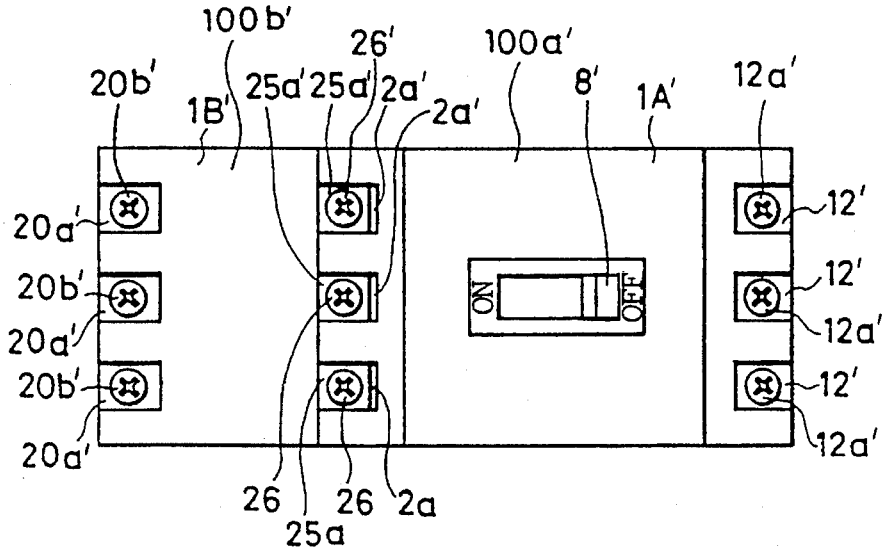
FIG. 4 is a plan view showing a current limiting circuit breaker in which the present invention may be employed.

A shown in FIG. 4, a current limiting circuit breaker, in which the present invention may be employed, may preferably comprise a circuit breaker unit 1A' and a current limiting unit 1B' which is attached to the side face of the circuit breaker unit 1A'. Three load side terminals 12' may be provided on the right side end of the circuit breaker unit 1A' shown in FIG. 4, and three power source side terminals **20*a'* may be provided on the left side end of the current limiting unit 1B' shown in FIG. 4. The circuit breaker unit 1A' and the current limiting unit 1B' can be formed integrally by connecting a conductor 2' of the circuit breaker unit 1A' and a connection conductor 25' of the current limiting unit 1B' (see FIG. 5**).

Figure 5:
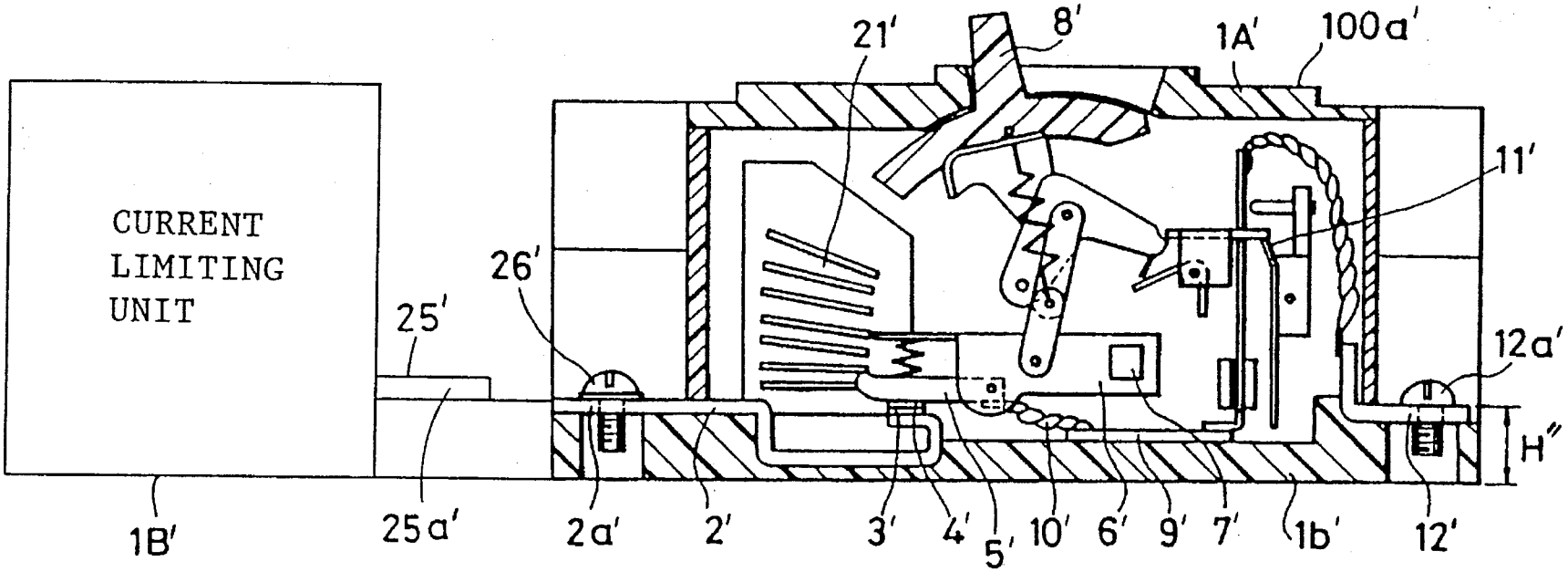
FIG. 5 is a longitudinal sectional side exploded view showing the current limiting circuit breaker of FIG. 4, with a current limiting unit removed therefrom.

In the circuit breaker unit 1A' shown in FIG. 5, for instance, three stationary conductors 2' may be fixed to a bottom **1*b'* of the circuit breaker casing 100*a'*, and, at the inner end of each of the stationary conductors 2', there can be corresponding stationary contacts 3'. Movable contacts 4', facing towards the stationary contacts 3', can be provided on movable members 5' which are movably held by contact arms 6', respectively. Each contact arm 6' can be rotatably supported by a cross bar 7'. An operation handle 8' can be provided projecting upward from the substantial center of the front face (upper face in FIG. 5) of the circuit breaker casing 100*a'*. The contact arms 6' can be turned about the cross bar 7' by turning the operation handle 8'. Conductors 9', which can be fixed to the bottom 1b' of the circuit breaker casing 100*a'*, can connect one end of the flexible connection members 10', and the other ends of the flexible connection members 10' can be connected to the movable members 5'. The fixed conductors 9' can be electrically connected to the load side terminals 12' through overcurrent trip units 11'**, respectively.

As shown in FIG. 5, the connection terminal **2*a'* having terminal screw bolts 26' and the load side terminal 12' having terminal screw bolts 12*a'* can be provided on both sides of the circuit breaker unit 1A'. A height (H') of the connection terminal 2*a'* and a height (H") of the load side terminal 12' can be provided at the same height measured between each upper face of them and the lower face of the circuit breaker casing 100*a*. A connection terminal 25*a'* of the connection conductor 25' can be projected from the side face of the current limiting unit 1B', and can be provided to ride on the connection terminal 2*a'* of the circuit breaker unit 1A'. The power source side terminal 20*a'* of the current limiting unit 1B' can be provided to have height H' from the rear face of the current limiting casing 100*b'* as shown in FIG. 4, and a terminal screw bolt 20*b'*** can be attached thereto.

As shown by the perspective view of FIG. 6, by assembling into a unit of the current limiting unit 1B' previously, the current limiting unit 1B' can be connected with the circuit breaker unit 1A', when the current limiting unit 1B' is juxtaposed with the circuit breaker unit 1A' as shown in FIGS. 4 and 5. Because the connection terminal **25*a'* of the current limiting unit 1B' is disposed on the connection terminal 2*a'* of the circuit breaker unit 1A', the current limiting unit 1B' can laterally be connected integrally with the circuit breaker unit 1A' by using the terminal screw bolt 26' as shown in FIG. 4**.

In FIG. 5, arc extinguishing chambers, disposed within housing **100*a'*, are indicated at 21'**.

Apart from the layout described hereinabove wherein one current limiting unit 1B' is connected with the circuit breaker unit 1A', a modification may be made such that essentially any number of current limiting units 1B' may be connected as needed. For example, three current limiting units 1B' may be connected in series as shown in FIGS. 7 and 8, thereby increasing current limiting ability.

One feature of the invention resides broadly in the contact system for a current limiting unit with a molded housing, consisting of a movable wiper 34 with a moving contact tip 28 on one end and an axis of rotation 44 on the other end, a supply lead 36 to be connected to the wiper 34, and which makes a transition into a first current lead 30, a stationary contact carrier 22 with a stationary contact tip 26 on one end and a second current lead 32 on the other end, preferably with a partial segment with a current direction opposite to that in the wiper 34, and also consisting of contact compression springs 72 mounted on one end of the wiper 34, characterized by the fact that the supply lead 36 is a one-piece component which makes a transition into a bearing 46 at which the axis of rotation 44 is mounted and as a result of application forces, there is a conductive connection to the wiper 34, the contact compression springs 72 are held with their other end on the supply lead 36, the wiper 34 is supported in the direction of the force of the contact compression springs 72 by covering the travel by means of a first support point 74, 76 on the supply lead 36, the wiper 34 is supported opposite to the direction of the force exerted by the contact compression springs 72 when it reaches the maximum opening angle by means of a second support point 78, 80 on the supply lead 36, the contact compression springs 72 can be mounted with their other end on the supply lead 36 so that during assembly, a lower force is exerted than in the final installed position.

Another feature of the invention resides broadly in the contact system characterized by the fact that there are helical contact compression springs 72 on which tension is exerted located on both sides next to the wiper 34, and these springs 72 are engaged in two dowels 68; 70 oriented at right angles to the direction of force, whereby the first dowel 68 is mounted in the wiper 34, and the plane formed by the application points of the contact compression springs 72 is located between the contact carrier 22 and the axis of rotation 44, a support block 58 made of insulating material is held at least non-positively by the force of the contact compression springs 72 on the supply lead 36, and has a holding groove 64 for the non-positive terminal mounting of the second dowel 70, on the support block 58, there is an auxiliary groove 62 for the non-positive intermediate mounting of the second dowel 70, whereby the auxiliary groove 62 is located in front of the holding groove 64 with respect to the contact carrier 22, and is connected to the latter by means of a slope 66.

Yet another feature of the invention resides broadly in the contact system characterized by the fact that the wiper 34 consists of wiper strips 42 which are symmetrical to one another, and which surround (enclose?) the bearing 46 on both sides at some distance from one another.

Still another feature of the invention resides broadly in the contact system characterized by the fact that an application spring 51 for the application pressure is mounted on the axis of rotation 44.

A further feature of the invention resides broadly in the contact system characterized by the fact that the supply lead 36 is a one-piece component which makes a transition into a prismatic support web 56 facing away from the moving contact tip 28, on which the support block 58 sits by means of a corresponding prismatic recess 60.

Another feature of the invention resides broadly in the contact system characterized by the fact that the first support point 74, 76 is located essentially between the axis of rotation 44 and the terminal points of engagement of the contact compression springs 72.

Yet another feature of the invention resides broadly in the contact system characterized by the fact that the first support point 74, 76 consists of the shoulders 74 formed on both sides of the supply lead 36 and support surfaces 76 on the ends of the wiper strips 42 which can be supported against them.

Still another feature of the invention resides broadly in the contact system characterized by the fact that the shoulders 74 are formed by the transition of the bearing 46 into the support web 56, which is thicker than the bearing point 46.

A further feature of the invention resides broadly in the contact system characterized by the fact that the second support point 78, 80 is formed by a stop surface 78 inclined at an angle which corresponds to the maximum opening angle of the contact system, and which is formed on the end of a stop web 82 which extends from the supply lead 36 and is a single piece with it, and portions 80 of the surface of the wiper 34 facing away from the moving contact tip 28 which can be supported against the stop web 82.

Another feature of the invention resides broadly in the contact system characterized by the fact that on the support block 58, symmetrically with respect to the holding groove 64, there are two identical auxiliary grooves 62 connected to the holding groove 64 by means of slopes 66, and the support block 58 is also symmetrical in relation to its longitudinal axis.

Examples of circuit breaker arrangements, and components thereof, which may be utilized in accordance with the embodiments of the present invention, may be found in the following U.S. Patents: U.S. Pat. No. 4,750,375 to Godesa, entitled "Drive Device for a Circuit Breaker with a Ratchet Wheel"; U.S. Pat. No. 4,678,,873 to Preuss and Berndt, entitled "Low Voltage Circuit Breaker . . . "; U.S. Pat. No. 4,380,785 to Demayer and Claudin, entitled "Solid State Trip Unit . . . " and U.S. Pat. No. 4,695,913 to Terracol and Roulet, entitled "Shunt Effect Low Voltage Circuit Breaker".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 34 577.8, filed on Oct. 11, 1993, having inventors Franz Böder and Bernd Howald, and DE-OS P 43 34 577.8 and DE-PS P 43 34 577.8, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

| Nomenclature (FIGS. 1–3) | |
|---|---|
| 2 | Bottom part |
| 4 | Cover |
| 6 | Terminal housing |
| 8 | Arcing chamber |
| 10 | Terminal opening |
| 12 | Contact system |
| 14 | Arc extinguisher stack |
| 16 | Separating plate |
| 18 | Blow-out valve plate |
| 20 | Cover |
| 22 | Contact carrier |
| 24 | Subsystem |
| 26; 28 | Contact tip |
| 30; 32 | Current lead |
| 34 | Wiper |
| 36 | Supply lead |
| 38 | Screw |
| 40 | Hole |
| 42 | Wiper strips |
| 44 | Axis of rotation |
| 46 | Bearing |
| 48; 50 | Bearing hole |
| 51 | Application spring |
| 52; 54 | Mounting hole |
| 56 | Support web |
| 58 | Support block |
| 60 | Recess |
| 61 | Ribs |
| 62 | Auxiliary groove |
| 64 | Holding groove |
| 66 | Slope |
| 68; 70 | Dowel |
| 72 | Contact compression spring |
| 74 | Shoulder |
| 76 | Support surface |
| 78 | Stop surface |
| 80 | Portion of surface |
| 82 | Stop web |

What is claimed is:

1. A current limiting unit comprising:

housing means;

a contact system disposed at least partly within said housing means;

said contact system comprising:

first lead means and second lead means;

said first lead means having means for connecting to first means for conveying electrical current;

said second lead means having means for connecting to second means for conveying electrical current;

means for providing electrical communication between said first lead means and said second lead means;

said means for providing electrical communication comprising:

wiper means, said wiper means having means for conveying electrical current;

first connecting means for electrically connecting said first lead means with said wiper means;

second connecting means for electrically connecting said wiper means with said second lead means;

means for displaceably mounting said wiper means to permit displacement of said wiper means away from said second lead means, to disengage said first contact portion from said second contact portion, to disrupt the electrical connection between said wiper means and said second lead means;

said second connecting means comprising:

a first contact portion disposed on said wiper means; and a second contact portion disposed on said second lead means;

said first contact portion and said second contact portion being engageable with one another to electrically connect said wiper means with said second lead means;

means for biasing said wiper means towards said second lead means, to maintain said first contact portion and said second contact portion in engagement with one another, to maintain the electrical connection between said wiper means and said second lead means;

means for displacing said wiper means away from said second lead means, to disengage said first contact portion from said second contact portion, to disrupt the electrical connection between said wiper means and said second lead means; and said wiper means, said first lead means, said biasing means, said first connecting means and said first contact portion forming a single, integral, pre-assembled unit.

2. The current limiting unit according to claim 1, wherein:

said first connecting means comprises means for mounting a portion of said biasing means;

said means for mounting having means for selectively mounting said portion of said biasing means at least at either of a first position and a second position; and said biasing means providing a greater biasing force of said wiper means toward said second lead means with said portion of said biasing means being mounted in said first position than with said portion of said biasing means being mounted in said second position.

3. The current limiting unit according to claim 2, wherein:

said means for mounting comprises a first mounting portion and a second mounting portion;

said first mounting portion having means for mounting said portion of said biasing means at said first position;

said second mounting portion having means for mounting said portion of said biasing means at said second position;

said biasing means comprises spring means;

said portion of said biasing means is a first connecting portion;

said biasing means further comprises a second connecting portion;

said means for mounting being a first mounting means;

said wiper means comprises second mounting means;

said first connecting portion being mounted at said first mounting means;

said second connecting portion being mounted at said second mounting means; and said first mounting portion being disposed further from said second mounting means than is said second mounting portion, to provide a greater biasing force of said wiper means toward said second lead means with said first connecting portion of said biasing means being mounted in said first position than with said first connecting portion of said biasing means being mounted in said second position.

4. The current limiting unit according to claim 3, further comprising:

means for arresting movement of said wiper means in a direction generally towards said second lead means; and said arresting means being disposed remotely with respect to said second connecting means.

5. The current limiting unit according to claim 4, wherein said arresting means is disposed to arrest movement of said wiper means, in a direction generally towards said second lead means, upon substantial wear of at least one of said first contact portion and said second contact portion.

6. The current limiting unit according to claim 5, wherein:

said arresting means comprises:

first support surface means being disposed on said wiper means; and second support surface means being disposed on said first lead means; and said first support surface means and said second support surface means being engageable with one another to arrest movement of said wiper means.

7. The current limiting unit according to claim 6, wherein:

said arresting means is a forward arresting means;

said current limiting unit further comprises rearward arresting means; and said rearward arresting means comprising means for arresting movement of said wiper means in a direction away from said second lead means.

8. The current limiting unit according to claim 7, wherein at least a portion of said rearward arresting means is fixedly mounted with respect to said first lead means.

9. The current limiting unit according to claim 8, wherein:

said rearward arresting means comprises:

third support surface means disposed on said wiper means; and fourth support surface means disposed on said first lead means; and said third and fourth support surface means being engageable with one another to arrest movement of said wiper means in a direction away from said second lead means.

10. The current limiting unit according to claim 9, wherein:

said means for displaceably mounting said wiper means is an integral extension of said first lead means;

said means for displaceably mounting said wiper means and said first lead means being an integral, one-piece component;

said means for displaceably mounting said wiper means comprising means for pivotally mounting said wiper means, said wiper means being pivotally displaceable towards and away from said second lead means;

said pivotal mounting means comprising shaft means for pivotally mounting said wiper means with respect to said means for displaceably mounting said wiper means, said shaft means comprising means for conducting electric current between said wiper means and said means for displaceably mounting said wiper means;

said means for displaceably mounting said wiper means providing electrical communication between said shaft means and said first lead means;

said rearward arresting means being configured to define a maximum opening angle of said wiper means with respect to said second lead means and prevent contact between said wiper means and said housing means;

said biasing means comprising a pair of contact compression springs;

said first connection portion comprising first rod means;

said second connection portion comprising second rod means;

each of said contact compression springs comprising:

a first end and a second end;

first means for engaging said first end of said contact compression spring with said first rod means; and second means for engaging said second end of said contact compression spring with said second rod means;

each of said contact compression springs being held in tension between said first rod means and said second rod means;

said first mounting means comprising block means, being fixedly attached, in a force-fit manner, to said first lead means;

said block means comprising said first mounting portion and said second mounting portion;

said block means further comprising:

a third mounting portion, said second and third mounting portions being symmetrically positioned with respect to said first mounting portion;

a first sloped portion extending between said first and second mounting portions, said first sloped portion comprising means for permitting slidable displacement of said first rod means between said first mounting portion and said second mounting portion;

a second sloped portion extending between said first and third mounting portions, said second sloped portion comprising means for permitting slidable displacement of said first rod means between said first mounting portion and said third mounting portion;

each of said first, second and third mounting portions having means for accommodating at least a portion of said first rod means;

said block means comprising insulating material and being electrically non-conductive;

said wiper means comprises first and second wiper strips being oriented generally parallel with respect to one another;

said first and second wiper strips flanking said means for displaceably mounting said wiper means;

said current limiting unit further comprises application spring means for biasing said first and second wiper strips towards one another, said application spring means having portions which flank said first and second wiper strips;

said means for displaceably mounting said wiper means being a single-piece component;

said first lead means being a one-piece component which makes a transition into a prismatic support web facing away from said first contact portion, on which said block means sits by means of a corresponding prismatic recess;

said first and second support surface means being located between an axis of rotation of said shaft means and both of said first and second rod means;

said first support surface means comprises a pair of shoulders formed on opposite sides of said first lead means;

said second support surface means being formed on ends of said wiper strips;

said shoulders being formed by the transition of said means for displaceably mounting said wiper means into said first lead means, said first lead means being thicker than said means for supporting said wiper means;

said fourth support surface means comprising a surface inclined at an angle which corresponds to the maximum opening angle of said wiper means, said inclined surface being formed on the end of a stop web which extends from said first lead means and constitutes and integral piece with respect to said first lead means;

said fourth support surface means comprising portions of the surface of said wiper means facing away from said first contact portion that can be supported against said stop web;

said first and third mounting portions are two identical auxiliary grooves; and said block means is symmetrical in relation to a longitudinal axis of said block means, this longitudinal axis being oriented generally parallel to a direction of travel of said wiper means.

11. A current limiting unit comprising:

housing means;

a contact system disposed at least partly within said housing means;

said contact system comprising:

first lead means and second lead means;

said first lead means having means for connecting to first means for conveying electrical current;

said second lead means having means for connecting to second means for conveying electrical current;

means for providing electrical communication between said first lead means and said second lead means;

said means for providing electrical communication comprising:

wiper means, said wiper means having means for conveying electrical current;

first connecting means for electrically connecting said first lead means with said wiper means;

second connecting means for electrically connecting said wiper means with said second lead means;

means for displaceably mounting said wiper means to permit displacement of said wiper means away from said second lead means, to disengage said first contact portion from said second contact portion, to disrupt the electrical connection between said wiper means and said second lead means;

said second connecting means comprising:

a first contact portion disposed on said wiper means; and a second contact portion disposed on said second lead means;

said first contact portion and said second contact portion being engageable with one another to electrically connect said wiper means with said second lead means;

means for biasing said wiper means towards said second lead means, to maintain said first contact portion and said second contact portion in engagement with one another, to maintain the electrical connection between said wiper means and said second lead means; and means for arresting movement of said wiper means in a direction away from said second lead means, to define a maximium opening of said wiper means with respect to said second lead means and minimize contact between said wiper means and said housing means.

12. The current limiting unit according to claim 11, wherein at least a portion of said arresting means is fixedly mounted with respect to said first lead means.

13. The current limiting unit according to claim 12, wherein:

said arresting means comprises:

support surface means disposed on said wiper means; and support surface means disposed on said first lead means; and said support surface means of said wiper means and said support surface means of said first lead means being engageable with one another to arrest movement of said wiper means in a direction away from said second lead means.

14. The current limiting unit according to claim 13, wherein said wiper means, said first lead means, said biasing means, said first connecting means and said first contact portion form a single, integral, pre-assembled unit.

15. The current limiting unit according to claim 14, wherein:

said first connecting means comprises means for mounting a portion of said biasing means;

said means for mounting having means for selectively mounting said portion of said biasing means at least at either of a first position and a second position; and said biasing means providing a greater biasing force of said wiper means toward said second lead means with said portion of said biasing means being mounted in said first position than with said portion of said biasing means being mounted in said second position.

16. The current limiting unit according to claim 15, wherein:

said means for mounting comprises a first mounting portion and a second mounting portion;

said first mounting portion having means for mounting said portion of said biasing means at said first position;

said second mounting portion having means for mounting said portion of said biasing means at said second position;

said biasing means comprises spring means;

said portion of said biasing means is a first connecting portion;

said biasing means further comprises a second connecting portion;

said means for mounting being a first mounting means;

said wiper means comprises second mounting means;

said first connecting portion being mounted at said first mounting means;

said second connecting portion being mounted at said second mounting means;

said first mounting portion being disposed further from said second mounting means than is said second mounting portion, to provide a greater biasing force of said wiper means toward said second lead means with said first connecting portion of said biasing means being mounted in said first position than with said first connecting portion of said biasing means being mounted in said second position;

said arresting means is a rearward arresting means;

said current limiting unit further comprising forward arresting means for arresting movement of said wiper means in a direction generally towards said second lead means;

said forward arresting means being disposed remotely with respect to said second connecting means;

said forward arresting means is disposed to arrest movement of said wiper means, in a direction generally towards said second lead means, upon substantial wear of at least one of said first contact portion and said second contact portion;

said forward arresting means comprises:

further support surface means being disposed on said wiper means; and further support surface means being disposed on said first lead means; and said further support surface means of said wiper means and said further support surface means of said first lead means being engageable with one another to arrest movement of said wiper means;

said further support surface means of said wiper means being first support surface means;

said further support surface means of said first lead means being second support surface means;

said support surface means of said wiper means being third support surface means;

said support surface means of said first lead means being fourth support surface means;

said means for displaceably mounting said wiper means is an integral extension of said first lead means;

said means for displaceably mounting said wiper means and said first lead means being an integral, one-piece component;

said means for displaceably mounting said wiper means comprising means for pivotally mounting said wiper means, said wiper means being pivotally displaceable towards and away from said second lead means;

said pivotal mounting means comprising shaft means for pivotally mounting said wiper means with respect to said means for displaceably mounting said wiper means, said shaft means comprising means for conducting electric current between said wiper means and said means for displaceably mounting said wiper means;

said means for displaceably mounting said wiper means providing electrical communication between said shaft means and said first lead means;

said rearward arresting means being configured to define a maximum opening angle of said wiper means with respect to said second lead means;

said biasing means comprising a pair of contact compression springs;

said first connection portion comprising first rod means;

said second connection portion comprising second rod means;

each of said contact compression springs comprising:

a first end and a second end;

first means for engaging said first end of said contact compression spring with said first rod means; and second means for engaging said second end of said contact compression spring with said second rod means;

each of said contact compression springs being held in tension between said first rod means and said second rod means;

said first mounting means comprising block means, being fixedly attached, in a force-fit manner, to said first lead means;

said block means comprising said first mounting portion and said second mounting portion;

said block means further comprising:

a third mounting portion, said second and third mounting portions being symmetrically positioned with respect to said first mounting portion;

a first sloped portion extending between said first and second mounting portions, said first sloped portion comprising means for permitting slidable displacement of said first rod means between said first mounting portion and said second mounting portion;

a second sloped portion extending between said first and third mounting portions, said second sloped portion comprising means for permitting slidable displacement of said first rod means between said first mounting portion and said third mounting portion;

each of said first, second and third mounting portions having means for accommodating at least a portion of said first rod means;

said block means comprising insulating material and being electrically non-conductive;

said wiper means comprises first and second wiper strips being oriented generally parallel with respect to one another;

said first and second wiper strips flanking said means for displaceably mounting said wiper means;

said current limiting unit further comprises application spring means for biasing said first and second wiper strips towards one another, said application spring means having portions which flank said first and second wiper strips;

said means for displaceably mounting said wiper means being a single-piece component;

said first lead means being a one-piece component which makes a transition into a prismatic support web facing away from said first contact portion, on which said block means sits by means of a corresponding prismatic recess;

said first and second support surface means being located between an axis of rotation of said shaft means and both of said first and second rod means;

said first support surface means comprises a pair of shoulders formed on opposite sides of said first lead means;

said second support surface means being formed on ends of said wiper strips;

said shoulders being formed by the transition of said means for displaceably mounting said wiper means into said first lead means, said first lead means being thicker than said means for supporting said wiper means;

said fourth support surface means comprising a surface inclined at an angle which corresponds to the maximum opening angle of said wiper means, said inclined surface being formed on the end of a stop web which extends from said first lead means and constitutes and integral piece with respect to said first lead means;

said fourth support surface means comprising portions of the surface of said wiper means facing away from said first contact portion that can be supported against said stop web;

said first and third mounting portions are two identical auxiliary grooves; and said block means is symmetrical in relation to a longitudinal axis of said block means, this longitudinal axis being oriented generally parallel to a direction of travel of said wiper means.

17. Method of assembling a current limiting unit, said method comprising the steps of:

providing housing means;

providing a contact system for being disposed at least partly within the housing means;

said step of providing a contact system comprising the steps of:

providing first lead means and second lead means;

said step of providing first lead means comprising the step of providing means for connecting to first means for conveying electrical current;

said step of providing second lead means comprising the step of providing means for connecting to second means for conveying electrical current;

providing means for providing electrical communication between the first lead means and the second lead means;

said step of providing means for providing electrical communication comprising the steps of:

providing wiper means, the wiper means having means for conveying electrical current;

providing first connecting means for electrically connecting the first lead means with the wiper means;

providing second connecting means for electrically connecting the wiper means with the second lead means;

providing means for displaceably mounting the wiper means to permit displacement of the wiper means away from the second lead means, to disengage said first contact portion from said second contact portion, to disrupt the electrical connection between said wiper means and said second lead means;

said step of providing second connecting means comprising the steps of:

providing a first contact portion and disposing the same on the wiper means; and providing a second contact portion disposing the same on the second lead means;

configuring the first contact portion and the second contact portion to be engageable with one another to electrically connect the wiper means with the second lead means;

providing means for biasing the wiper means towards the second lead means, to maintain the first contact portion and the second contact portion in engagement with one another, to maintain the electrical connection between the wiper means and the second lead means; and forming the wiper means, the first lead means, the biasing means, the first connecting means and the second connecting means as a single, integral, pre-assembled unit;

said method further comprising the additional steps of:

storing the single, integral pre-assembled unit constituted by the wiper means, the first lead means, the biasing means, the first connecting means and the first contact portion; and installing the single, integral pre-assembled unit at least partly within the housing means.

18. The method according to claim 17, wherein:

said step of providing first connecting means comprises providing means for mounting a portion of said biasing means, said means for mounting having means for selectively mounting said portion of said biasing means at least at either of a first position and a second position; and said method comprises configuring said means for mounting such that said biasing means provide a greater biasing force of said wiper means toward said second lead means with said portion of said biasing means being mounted in said first position than with said portion of said biasing means being mounted in said second position; and said method further comprises the additional steps of:

mounting said portion of said biasing means in said second position, and retaining said portion of said biasing means in said second position, during said storing of the single, integral pre-assembled unit constituted by the wiper means, the first lead means, the biasing means, the first connecting means and the first contact portion; and mounting said portion of said biasing means in said first position, and retaining said portion of said biasing means in said first position, during said installing step.

19. The method according to claim 18, wherein: said step of providing mounting means comprises providing a first mounting portion and a second mounting portion, said first mounting portion having means for mounting said portion of said biasing means at said first position, said second mounting portion having means for mounting said portion of said biasing means at said second position;

configuring said biasing means to comprise spring means;

configuring said contact system such that:

said portion of said biasing means is a first connecting portion;

said biasing means further comprises a second connecting portion;

said means for mounting is a first mounting means;

said wiper means comprises second mounting means;

said first connecting portion is mounted at said first mounting means;

said second connecting portion is mounted at said second mounting means; and said first mounting portion is disposed further from said second mounting means than is said second mounting portion, to provide a greater biasing force of said wiper means toward said second lead means with said first connecting portion of said biasing means being mounted in said first position than with said first connecting portion of said biasing means being mounted in said second position.

20. The method according to claim 19, further comprising the step of configuring said current limiting unit to comprise:

means for arresting movement of said wiper means in a direction generally towards said second lead means;

said arresting means being disposed remotely with respect to said second connecting means;

said arresting means is disposed to arrest movement of said wiper means, in a direction generally towards said second lead means, upon substantial wear of at least one of said first contact portion and said second contact portion;

said arresting means comprises:

first support surface means being disposed on said wiper means; and second support surface means being disposed on said first lead means;

said first support surface means and said second support surface means being engageable with one another to arrest movement of said wiper means;

said arresting means is a forward arresting means;

said current limiting unit further comprises rearward arresting means;

said rearward arresting means comprising means for arresting movement of said wiper means in a direction away from said second lead means;

at least a portion of said rearward arresting means is fixedly mounted with respect to said first lead means;

said rearward arresting means comprises:

third support surface means disposed on said wiper means; and fourth support surface means disposed on said first lead means;

said third and fourth support surface means being engageable with one another to arrest movement of said wiper means in a direction away from said second lead means;

said means for displaceably mounting said wiper means is an integral extension of said first lead means;

said means for displaceably mounting said wiper means and said first lead means being an integral, one-piece component;

said means for displaceably mounting said wiper means comprising means for pivotally mounting said wiper means, said wiper means being pivotally displaceable towards and away from said second lead means;

said pivotal mounting means comprising shaft means for pivotally mounting said wiper means with respect to said means for displaceably mounting said wiper means, said shaft means comprising means for conducting electric current between said wiper means and said means for displaceably mounting said wiper means;

said means for displaceably mounting said wiper means providing electrical communication between said shaft means and said first lead means;

said rearward arresting means being configured to define a maximum opening angle of said wiper means with respect to said second lead means and prevent contact between said wiper means and said housing means;

said biasing means comprising a pair of contact compression springs;

said first connection portion comprising first rod means;

said second connection portion comprising second rod means;

each of said contact compression springs comprising:

a first end and a second end;

first means for engaging said first end of said contact compression spring with said first rod means; and second means for engaging said second end of said contact compression spring with said second rod means;

each of said contact compression springs being held in tension between said first rod means and said second rod means;

said first mounting means comprising block means, being fixedly attached, in a force-fit manner, to said first lead means;

said block means comprising said first mounting portion and said second mounting portion;

said block means further comprising:

a third mounting portion, said second and third mounting portions being symmetrically positioned with respect to said first mounting portion;

a first sloped portion extending between said first and second mounting portions, said first sloped portion comprising means for permitting slidable displacement of said first rod means between said first mounting portion and said second mounting portion;

a second sloped portion extending between said first and third mounting portions, said second sloped portion comprising means for permitting slidable displacement of said first rod means between said first mounting portion and said third mounting portion;

each of said first, second and third mounting portions having means for accommodating at least a portion of said first rod means;

said block means comprising insulating material and being electrically non-conductive;

said wiper means comprises first and second wiper strips being oriented generally parallel with respect to one another;

said first and second wiper strips flanking said means for displaceably mounting said wiper means;

said current limiting unit further comprises application spring means for biasing said first and second wiper strips towards one another, said application spring means having portions which flank said first and second wiper strips;

said means for displaceably mounting said wiper means being a single-piece component;

said first lead means being a one-piece component which makes a transition into a prismatic support web facing away from said first contact portion, on which said block means sits by means of a corresponding prismatic recess;

said first and second support surface means being located between an axis of rotation of said shaft means and both of said first and second rod means;

said first support surface means comprises a pair of shoulders formed on opposite sides of said first lead means;

said second support surface means being formed on ends of said wiper strips;

said shoulders being formed by the transition of said means for displaceably mounting said wiper means into said first lead means, said first lead means being thicker than said means for supporting said wiper means;

said fourth support surface means comprising a surface inclined at an angle which corresponds to the maximum opening angle of said wiper means, said inclined surface being formed on the end of a stop web which extends from said first lead means and constitutes and integral piece with respect to said first lead means;

said fourth support surface means comprising portions of the surface of said wiper means facing away from said first contact portion that can be supported against said stop web;

said first and third mounting portions are two identical auxiliary grooves; and said block means is symmetrical in relation to a longitudinal axis of said block means, this longitudinal axis being oriented generally parallel to a direction of travel of said wiper means.

* * * * *